US008424725B2

(12) United States Patent
Boyer

(10) Patent No.: US 8,424,725 B2
(45) Date of Patent: Apr. 23, 2013

(54) BEVERAGE PROPORTIONING

(75) Inventor: George C. Boyer, Rockton, IL (US)

(73) Assignee: Carrier Corporation, Farmington, CT (US)

( * ) Notice: Subject to any disclaimer, the term of this patent is extended or adjusted under 35 U.S.C. 154(b) by 559 days.

(21) Appl. No.: 12/521,069

(22) PCT Filed: Dec. 28, 2006

(86) PCT No.: PCT/US2006/049614
§ 371 (c)(1),
(2), (4) Date: Feb. 10, 2010

(87) PCT Pub. No.: WO2008/082394
PCT Pub. Date: Jul. 10, 2008

(65) Prior Publication Data
US 2010/0127015 A1 May 27, 2010

(51) Int. Cl.
*B67D 7/80* (2010.01)

(52) U.S. Cl.
USPC ..... 222/146.6; 222/1; 222/14; 222/65; 222/66; 222/129.1; 222/134; 222/135; 222/145.5

(58) Field of Classification Search ..... 222/1, 14, 222/54–66, 71, 72, 129.1, 129.3, 129.4, 134, 222/135, 145.1, 145.5, 145.6, 146.6
See application file for complete search history.

(56) References Cited

U.S. PATENT DOCUMENTS

| | | | | |
|---|---|---|---|---|
| 3,357,598 | A | 12/1967 | Kraft | |
| 3,638,392 | A * | 2/1972 | Welker et al. | 53/503 |
| 3,731,777 | A * | 5/1973 | Burke et al. | 194/217 |
| 4,638,924 | A * | 1/1987 | Newsom | 222/1 |
| 4,821,925 | A | 4/1989 | Wiley et al. | |
| 5,072,853 | A | 12/1991 | Shannon | |
| 5,314,703 | A | 5/1994 | Gibney et al. | |
| 5,636,763 | A | 6/1997 | Furness | |
| 6,082,123 | A | 7/2000 | Johnson | |
| 6,446,834 | B2 * | 9/2002 | Davis et al. | 222/52 |
| 6,478,192 | B2 * | 11/2002 | Heyes | 222/144.5 |
| 6,496,752 | B2 * | 12/2002 | Sudolcan et al. | 700/239 |
| 6,848,600 | B1 | 2/2005 | Crisp, III | |
| 2006/0027267 | A1 | 2/2006 | Fritze | |
| 2008/0073376 | A1 * | 3/2008 | Gist et al. | 222/145.5 |

OTHER PUBLICATIONS

International Search Report and Written Opinion mailed Sep. 27, 2007 (7 pgs.).
International Preliminary Report on Patentability mailed Apr. 15, 2011.

* cited by examiner

*Primary Examiner* — J. Casimer Jacyna
(74) *Attorney, Agent, or Firm* — Cantor Colburn LLP

(57) ABSTRACT

A semi-frozen beverage dispenser with an improved flow proportioning mechanism is provided. In a filling cycle, a first valve regulating the syrup flow opens first to deliver a predetermined volume before it closes and a second valve regulating the water flow opens to deliver a volume according to the desired water to syrup ratio. A common flow sensor measures the liquid flow volume for both the syrup and water and provides the information to the control system. If it takes too long to deliver the expected volume, the system gives out a liquid-low warning.

9 Claims, 5 Drawing Sheets

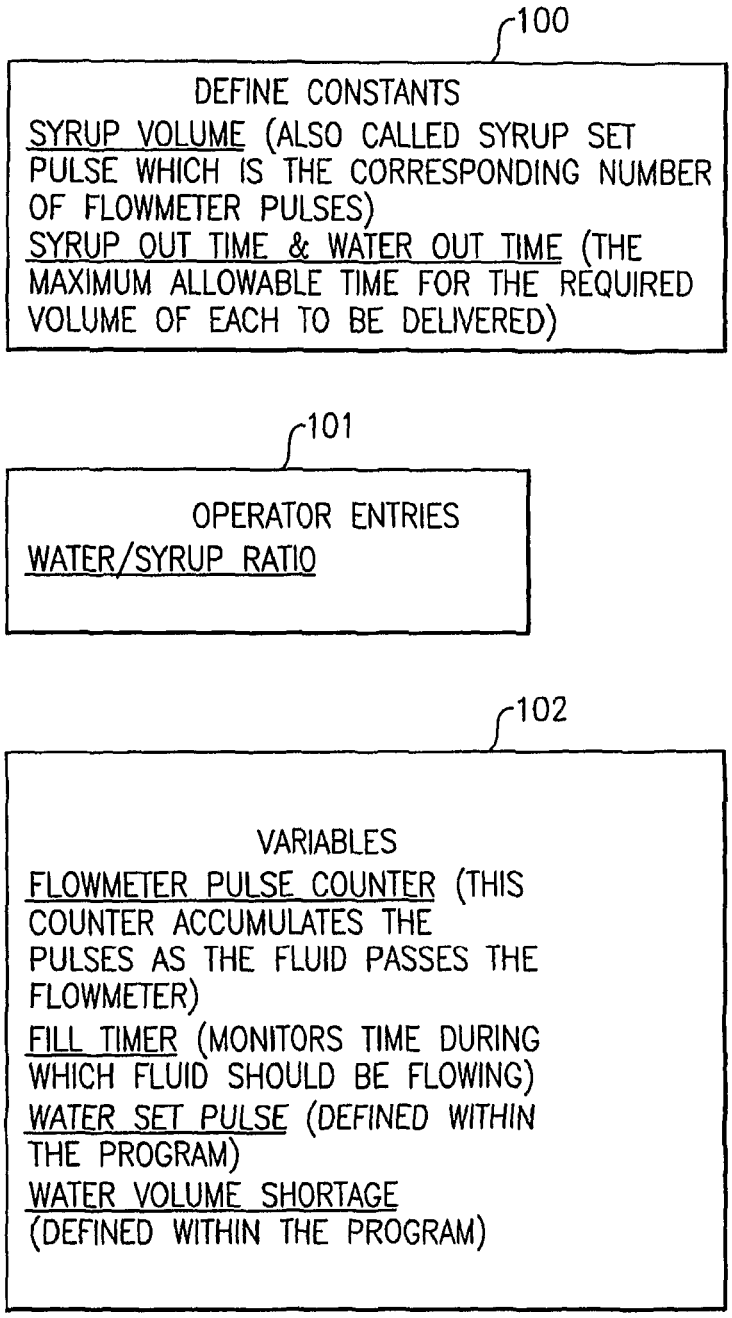
FIG.4A(1)

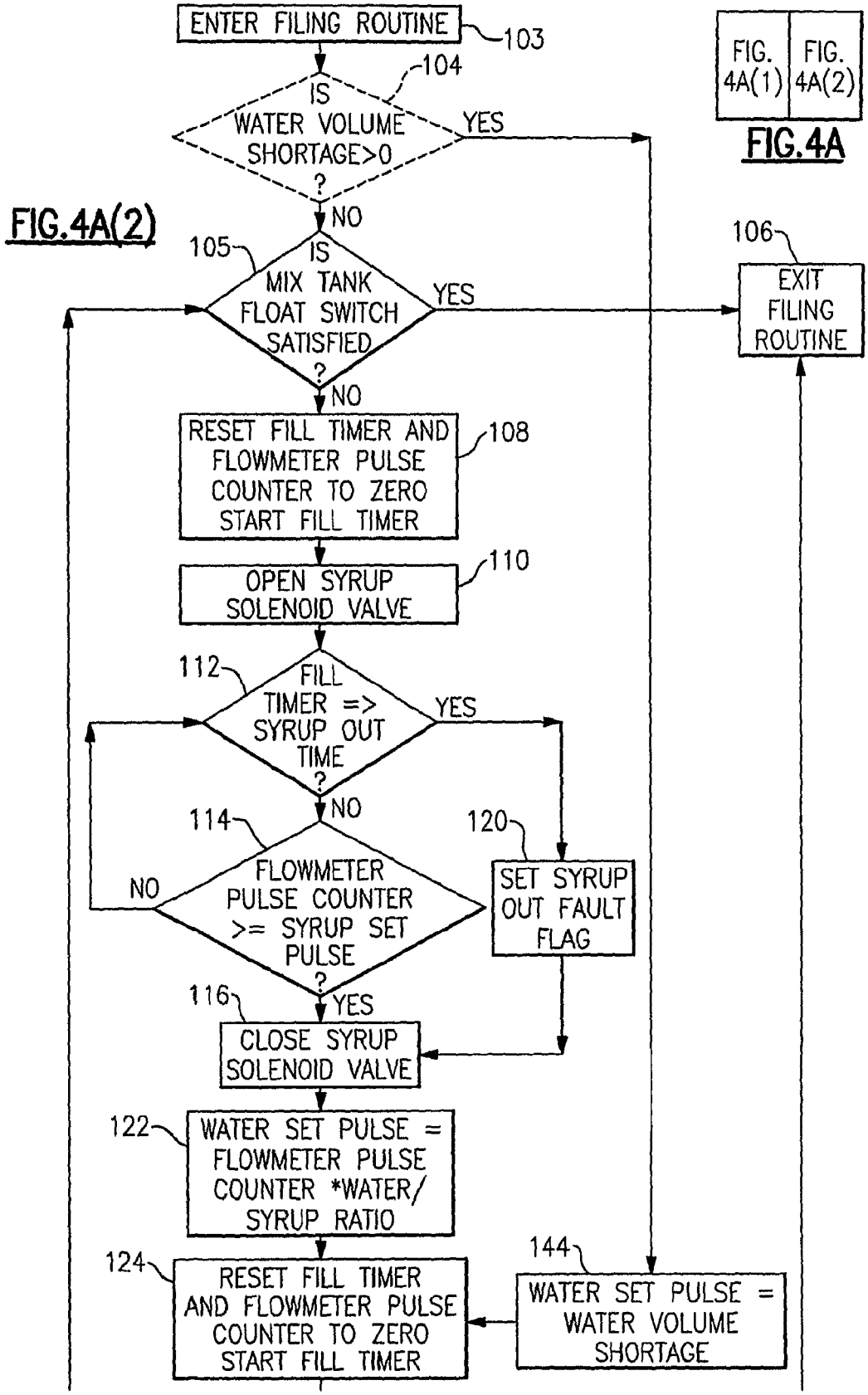
ENTER FILING ROUTINE
103
104
IS WATER VOLUME SHORTAGE>0 ?
YES
NO
FIG. 4A(1)
FIG. 4A(2)
FIG.4A
FIG.4A(2)
105
IS MIX TANK FLOAT SWITCH SATISFIED ?
YES
NO
106
EXIT FILING ROUTINE
RESET FILL TIMER AND FLOWMETER PULSE COUNTER TO ZERO START FILL TIMER
108
OPEN SYRUP SOLENOID VALVE
110
112
FILL TIMER => SYRUP OUT TIME ?
YES
NO
114
FLOWMETER PULSE COUNTER >= SYRUP SET PULSE ?
NO
YES
120
SET SYRUP OUT FAULT FLAG
116
CLOSE SYRUP SOLENOID VALVE
122
WATER SET PULSE = FLOWMETER PULSE COUNTER *WATER/ SYRUP RATIO
124
RESET FILL TIMER AND FLOWMETER PULSE COUNTER TO ZERO START FILL TIMER
144
WATER SET PULSE = WATER VOLUME SHORTAGE

BEVERAGE PROPORTIONING

TECHNICAL FIELD

The invention generally relates to liquid or semi-liquid dispensing systems in general, and more particularly, to semi-frozen food and beverage product dispensers where one or more syrups are mixed in a potable liquid diluent, and provided in partially frozen or frozen states.

BACKGROUND OF THE INVENTION

Liquid and semi-liquid dispensers are widely used in various industries. In the food and beverage industry, certain products are provided in partially frozen, semi-frozen or frozen states. Sometimes, the products are called "slush." For purpose of the present disclosure, the term "semi-frozen beverage dispenser" is meant to include beverage dispensers that produce partially frozen, semi-frozen or frozen products, whether they are postmix (separate ingredients reconstituted into a final product in the machine) or premix (prepackaged with the final constituents), carbonated or non-carbonated. Sometimes, the machines are referred to as a "granita" machine. An exemplary semi-frozen beverage dispenser for purpose of the present disclosure is a frozen carbonated beverage (FCB) machine.

FCB machines known in the art generally pump potable water through a carbonator tank that contains pressurized carbon dioxide in order to make carbonated water. The carbonated water and at least one concentrated syrup are then conducted to the same mixing container at a particular ratio, before further delivered to a freezing cylinder. A sampling valve is sometimes provided before the mixture of the carbonated water and the syrup reaches the mixing container to provide a chance for sampling. An evaporator coil or a similar refrigeration mechanism is provided to chill the contents in the freezing cylinder to a slush form. Some form of a scraper, blade or auger rotates or otherwise moves to scrape the thin frozen layer from the internal surface of the cylinder and to maintain flavor consistency within the slush.

Existing mechanisms for regulating the water to syrup ratio (brix) typically involve the use of a ceramic sleeve fitted over a piston for the syrup conduit. When the mixing container needs to be refilled, both the syrup conduit and the water conduit are opened simultaneously or substantially so to allow syrup and water to flow into the mixing container. An operator mechanically adjusts the spring tension that in turn changes the clearance between the sleeve and the piston in order to adjust the syrup flow rate.

The clearance between the sleeve and the piston can be as little as 0.01 inch (0.25 mm) in radius. As a result, the system is prone to brix control failure when particulates get logged in the clearance. Also, panels have to be removed in order to mechanically access the point for adjusting the clearance. In view of the above, there is a strong need for a more reliable and less cumbersome mechanism for regulating the water to syrup ratio in a semi-frozen beverage dispenser.

SUMMARY OF THE INVENTION

The present invention relates to various features of an improved liquid dispenser. These features will be discussed, for purpose of illustration, in the context of food and beverage industry but should not be contemplated to be limited to such applications.

The present invention improves upon the proportioning mechanism in the dispenser so that a desired mixing ratio among at least two liquids is ensured.

In one aspect, the invention provides a semi-frozen beverage dispenser that has two valves, each regulating a different liquid flow into a mixing container. The valves are configured, e.g., programmed, such that at any given time, not more than one of them is open. In one feature, in each regular filling cycle, the valves are configured such that the first valve opens first for a preset time, after which the second valve opens. In one embodiment, the first valve regulates a syrup flow and the second valve regulates a diluent, e.g., potable water, flow. The dispenser may further include a microprocessor-equipped control system that controls the opening and closing of both valves, and a flow sensor situated downstream of both valves that communicates to the control system the volume of any liquid flow that has passed by the sensor.

In another aspect, the invention provides semi-frozen beverage dispenser that has a mixing container, a first valve situated in a syrup pathway for regulating a syrup flow into the mixing container, a second valve situated in a diluent pathway for regulating a diluent flow into the mixing container; a flow sensor situated downstream of both valves and upstream of the mixing container for generating a signal relating to the volume of any liquid flow that has passed by the sensor; and a control system in electronic communication with the flow sensor for receiving its signal, the control system being configured to shut off the first valve after the flow sensor has indicated that a first preset volume of syrup has passed by and to consequentially open the second valve to allow a second preset volume of diluent to pass by the sensor before the control system shuts off the second valve, such that a desired ratio between the syrup and the diluent is achieved in the mixing container.

In one embodiment, the semi-frozen beverage dispenser further includes a flow restrictor. The dispenser may also include a freezing cylinder downstream of the mixing container, or the mixing container may also serve as a freezing cylinder, i.e., the mixing container is also configured to chill its content.

In one feature, the control system is configured to diagnose that syrup is out when the first preset volume of syrup fails to pass by the sensor in a predetermined time. In one embodiment, the control system is further configured to adjust the volume of diluent in the same filling cycle, after it has diagnosed that syrup is out, to maintain the desired ratio between the syrup and the diluent in the mixing container. In another feature, the control system is configured to diagnose that diluent is out when the second preset volume of diluent fails to pass by the sensor in a predetermined time. In one embodiment, the control system is further configured, after it has diagnosed that diluent is out, to maintain the desired ratio between the syrup and the diluent in the mixing container by requiring an additional volume of diluent delivered to the mixing container to make up the shortfall. In one feature, the flow sensor is capable of distinguishing between liquid and gas.

In yet another aspect, a method for achieving a desired ratio between a diluent and at least one syrup in a semi-frozen beverage dispenser is provided by the invention. The method includes the steps of:

providing a first valve to regulate a syrup flow into a mixing container;

providing a second valve to regulate a diluent flow into the mixing container;

providing a flow sensor downstream of both valves and upstream of the mixing container;

opening the first valve, and shutting it off after the flow sensor has sensed that a first preset volume of syrup has passed by; and consequently opening the second valve to allow a second preset volume of diluent to enter the mixing container, the ratio between the second preset volume and the first preset volume being the desired ratio.

The method may further include the steps of diagnosing that syrup is out when the first preset volume of syrup fails to pass by the sensor in a predetermined time, and further adjusting the volume of diluent in the same filling cycle, after syrup has been diagnosed as out, to maintain the desired ratio. The method may also include the step of diagnosing that diluent is out when the second preset volume of diluent fails to pass by the sensor in a predetermined time.

BRIEF DESCRIPTION OF THE DRAWINGS

The foregoing, and other features and advantages of the invention, as well as the invention itself, will be more fully understood from the description, drawings and claims that follow. The drawings are not necessarily to scale, emphasis instead generally being placed upon illustrating the principles of the invention. In the drawings, like numerals are used to indicate like parts throughout the various views and various embodiments.

FIGS. 4A and 4B together constitute a block diagram showing stepwise how the control system of the present invention is programmed for its functions.

DETAILED DESCRIPTION OF THE INVENTION

Features of the invention may work by itself or in combination as shall be apparent to by one skilled in the art. The lack of repetition is meant for brevity and not to limit the scope of the claim. Unless otherwise indicated, all terms used herein have the same meaning as they would to one skilled in the art of the present invention.

The term "beverage" as used herein refers to a liquid or a semi-liquid for consumption, and includes but are not limited to, juices, syrups, sodas (carbonated or still), water, milk, yogurt, slush, ice-cream, other dairy products, and any combination thereof, with or without alcohol and other additives.

The terms "control system," "central control," "control circuit," "central control system" and "control" as a noun are used interchangeably herein.

The term "liquid" as used herein refers to a pure liquid and a mixture where a significant portion is liquid such that the mixture may be liquid, semi-liquid or contains small amounts of solid substances.

Figure 1:
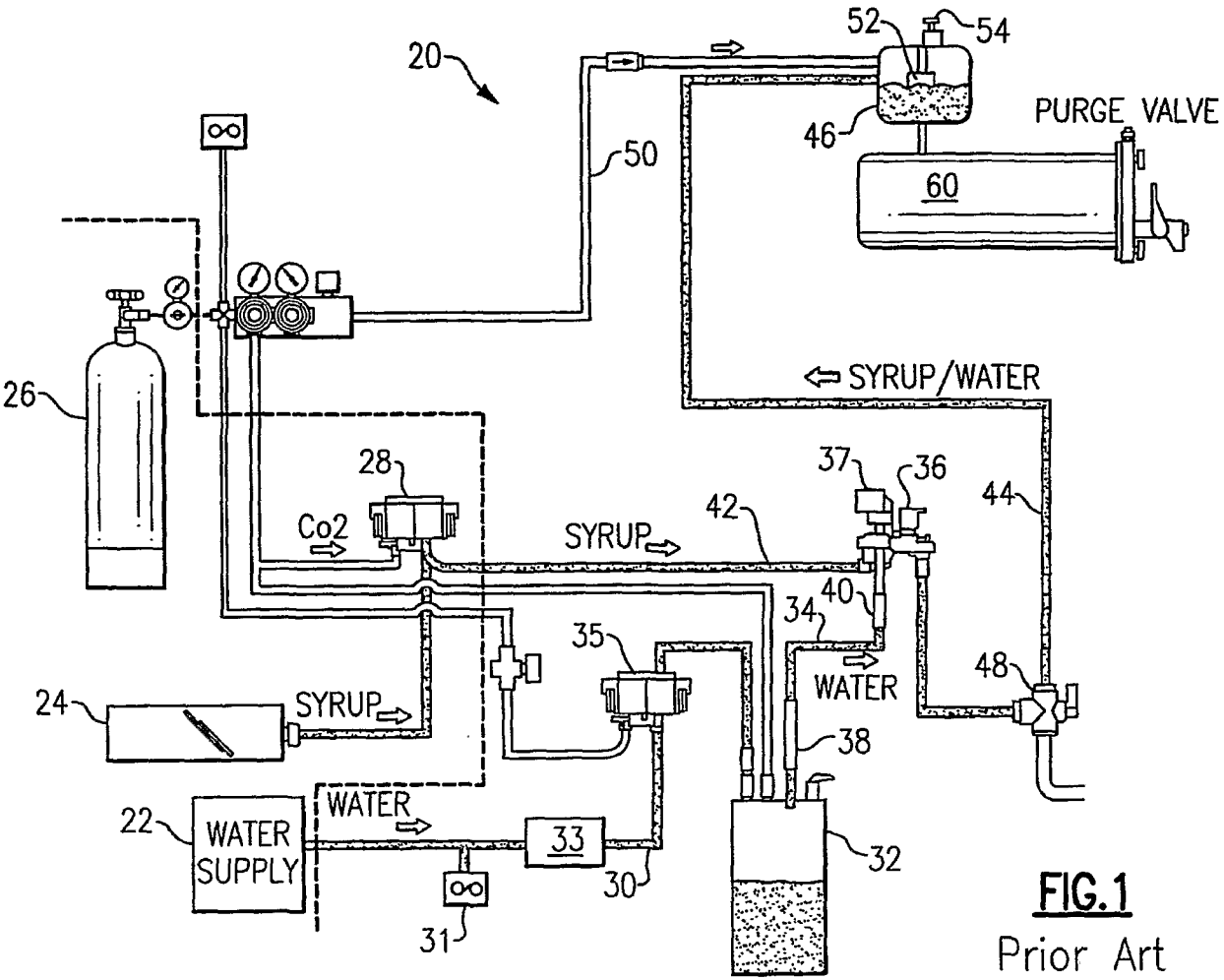
FIG.1 Prior Art
FIG. 1 is a schematic view of frozen carbonated beverage machine with a conventional beverage flow control system that can be readily upgraded to the one disclosed by the present invention.

FIG. 1 provides a schematic presentation of an exemplary FCB machine to illustrate a semi-frozen beverage dispenser in general and a conventional beverage flow control mechanism in particular. In general, an FCB dispenser 20 is connected to a source 22 of a liquid diluent, typically potable water, a syrup source 24, and a regulated $CO_2$ source 26. These three items, along with some other parts and fixtures such as the syrup pump 28, are typically remote items placed outside the dispenser 20, and are so indicated with the dotted line. Inside the dispenser 20, water is conducted from its source 22 through a conduit 30 to a carbonator 32 where pressurized $CO_2$ is also conducted from the regulated $CO_2$ source 26. As one skilled in the art would understand, the following parts may be found along this portion of the water route: a pressure switch 31, a water regulator 33, and a water pump 35.

Still referring to FIG. 1, carbonated water flows out of the carbonator 32 via conduit 34 into a flow control device 36. As one skilled in the art would understand, there may be a water filter 38 and a one-way check valve 40 along the water route. Syrup is also conducted from its source 24, e.g., a bag-in-box, via pump 28 and conduit 42 to the flow control 36. A pressure switch 37 is located just before the syrup flow enters the flow control 36. Combining right after the flow control 36, syrup and water together flows via conduit 44 into a mixing container 46. A sampling valve 48 may be provided along conduit 44 to provide a chance for an operator to sample the makeup of the syrup/water mixture. Additional carbonation may be provided as $CO_2$ is conducted from its tank 26 via conduit 50 into the mixing container 46. Often, there is a float 52 in the mixing container 46 that indicates the fluid level inside. A pressure relief valve 54 may also be installed at the mixing container 46. Carbonated syrup with water is consequently delivered from the mixing container 46 into a freezing cylinder 60 where further chilling of the mixture takes place to form slush. Finally, the semi-frozen product is dispensed through a nozzle 62 to a customer.

Figure 2:
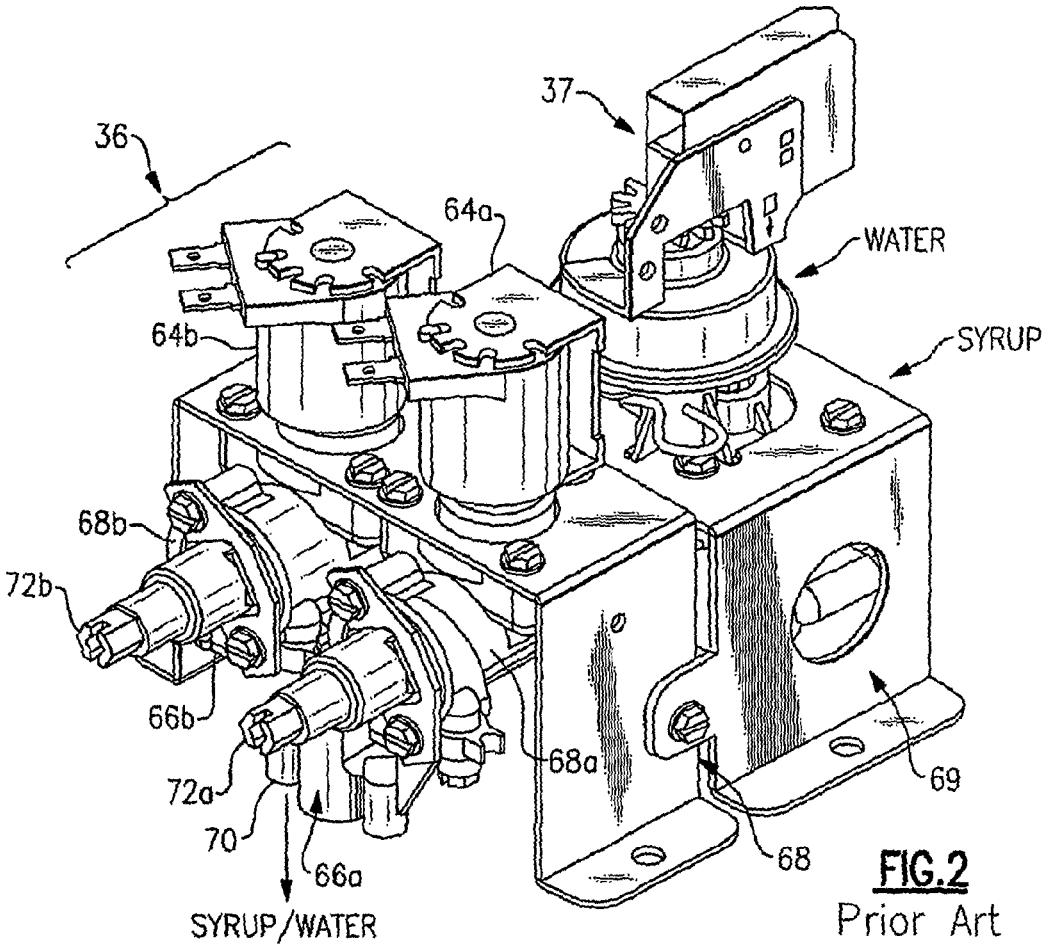
FIG.2 Prior Art
FIG. 2 is perspective view of the conventional flow control system shown in FIG. 1.

The conventional proportioning mechanism illustrated in FIG. 1 mainly consists of the flow control 36. Referring now to FIG. 2, in a more detailed view, the conventional flow control 36 includes two coil solenoid valves 64*a* and 64*b* that control the syrup flow and the water flow, respectively. The flow control 36 further includes two sleeve-over-piston structures 68*a* and 68*b* that regulate the rate of flow for syrup and water, respectively. The pressure switch 37 generates a signal indicating syrup supply is low or out when it senses certain low pressure in the syrup flow. The flow control 36 and the adjacent syrup pressure switch 37 are further affixed to two mounting brackets 68 and 69.

In operation, the float in the mixing container 46 (FIG. 1) generates a signal to a central control (not shown) when the level of liquid in the container hits a certain low level. The central control in turn causes both solenoid valves 64*a* and 64*b* to open at the same time, allowing syrup and water to flow through the clearance in the sleeve-over-piston structures 68*a* and 68*b* before the two combine and exit from an outlet 70 onto the next portion of the delivery process. As mentioned previously, the flow rates for the syrup and water are mechanically adjusted. Specifically, by turning a hexagonal screw cap 72*a*, an operator can tighten or loosen, through spring tension, the clearance between the sleeve and piston, thereby allowing less or more amount of syrup to go through in a unit time. Similarly, a hexagonal screw cap 72*b* is used to mechanically adjust the rate of water flowing into the mixing container.

Besides being prone to particulate-jamming and being cumbersome to adjust as previously mentioned, the conventional proportioning mechanism cannot ensure that the desired brix ratio is maintained when a problem arises with either syrup or water. For example, if the syrup is running low, the entire filling cycle will be compromised in the sense that its syrup content will be under target. This is because the syrup flow and the water flow, typically valve-controlled, are open at or substantially at the same time in each filling cycle. By the time low-syrup is detected by a pressure switch in a given filling cycle, the amount of water meant for the right amount of syrup has been already delivered into the mixing container, resulting in lower syrup content than desired. Maintaining the correct brix ratio is not only important for taste reasons, but also necessary to avoid excessive amount of freezing in the freezing cylinder which may damage the parts.

Figure 3:
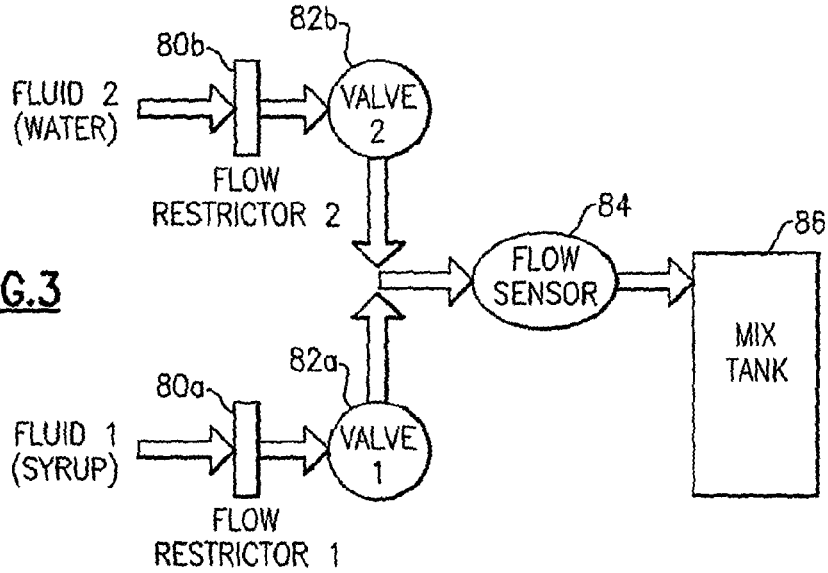
FIG. 3 is a schematic view of an embodiment of the proportioning or flow control system of the invention.

Referring now to FIG. 3, in an embodiment of the present invention, the proportioning mechanism is completely electronic and is configured such that at any given time, not more than one of the valves is open. Schematically, in the pathway for a first fluid, e.g., a first type of syrup, a first, optional flow restrictor 80*a* is situated upstream of a first solenoid valve 82*a*. In the pathway for a second fluid, e.g., typically a diluent like water, a second, optional flow restrictor 80*b* is situated upstream of a second solenoid valve 82*b*. Both valves 82*a* and 82*b* are situated upstream of a single flow sensor 84 as the two fluids' pathways combine before entering the further downstream mixing container 86. The flow restrictors 80*a* and 80*b* function to limit the maximal rate of flow for each fluid based upon the typical operating pressures. One skilled in the art will recognize that the restrictor could be a separate device as illustrated or the orifice inside the valve (82*a* or 82*b*). The flow sensor 84 is used to measure the volume of both fluid flows and is configured to communicate, e.g., electronically, such information to a central control system (not shown), which in turn, electromagnetically controls the opening and closing of the solenoid valves 82*a* and 82*b*.

Individual parts depicted in FIG. 3 are commercially available. For example, the flow sensor 84 can be a commercially available liquid flowmeter, rotameter or sensor that, e.g., gives out a signal regarding the volume of the fluid that has passed by it. Examples of such sensors include liquid turbine or impeller flowmeters manufactured by JLC International of New Britain, Pa. and by Universal Flow Monitors, Inc. of Hazel Park, Mich. The central control system may include a microprocessor, one or more printed circuit boards and other components well known in the industry for performing various computation, processing, and memory functions. The central control system could also maintain and regulate refrigeration, fluid delivery, dispensing and other functions of the machine. The proportioning mechanism of the present invention such as the system depicted by FIG. 3, can be readily integrated into an existing beverage dispenser to replace a more conventional flow control or proportioning system. For example, in the FCB dispenser 20 depicted in FIG. 1, the flow control 36 and the conduits around it can be replaced with the system depicted in FIG. 3 while the rest of the dispenser including parts involved in refrigeration, mixing and dispensing remain largely intact. In one embodiment, after passing by the flow sensor of the present invention, fluids are conducted directly into the freezing cylinder—in other words, the mixing container or tank illustrated in FIG. 1 is eliminated from the FCB machine. In that case, the freezing cylinder also serves the function as a mixing container.

According to the present invention, the proportioning mechanism is configured, e.g., programmed, such that when liquid level in the mixing container 86 drops to a preset level, valve 82*a* opens. This can be accomplished through a signaling pathway from a float switch in the mixing container to the central control system, which in turn, opens the valve 82*a*. If the mixing container also function as a freezing cylinder where refrigeration takes place, a pressure trigger can be used in place of the float switch. After a preset amount of syrup is delivered, the valve 82*a* closes. This is accomplished as the flow sensor 84 sends information on the amount of syrup it senses as having passed by to the central control system, which in turn, closes the valve 82*a* when the preset amount has been delivered. Consequently, the central control system opens the other valve 82*b* to deliver a specific amount of water. This amount is calculated by the control system based on a desired water to syrup ratio stored or manually entered. Once the flow sensor 84 detects that the desired amount of water has been delivered, the central control system closes the valve 82*b*. This protocol of sequential valve operation repeats until the liquid level in the mixing container 86 is satisfied but will always end with water being delivered to the mixing container last. And if the float switch in the mixing container is satisfied during a filling cycle, the cycle will continue to maintain overall brix ratio. Therefore, the float switch should be set to be satisfied before the liquid level in the mixing container is one filling cycle away from the container's capacity to avoid overflow.

In one feature, since both the flow rates of syrup and water are known as the pressure in each pathway is regulated, the central control is able to calculate the time that the flow sensor 84 should expect for the desired amount of each fluid to pass by when their respective valve is open. When it takes significantly longer for a desired volume to pass by the flow sensor, the control will diagnose that particular fluid to be low or out. A corresponding warning will be given off for the operator to remedy the situation. In one embodiment, when the syrup is out or low, the control suspends the filling cycle until the syrup supply is replenished. The filling cycle is resumed only after the original set amount of syrup is delivered. In a preferred embodiment, however, the control suspends further syrup delivery but completes that particular filling cycle by immediately switching to water and delivers a less amount of water that still conforms to the desired water to syrup ratio. In one embodiment, if problem occurs with water supply, the control will not proceed to the next filling cycle involving any syrup until water supply is restored, and an additional volume of water is delivered to make up the shortfall.

Because the flow sensor 84, according to this feature of the invention, would be able to detect syrup low/out and water low/out situations and give out corresponding diagnoses, additional parts previously used for those functions, such as the pressure switch 31 in the water pathway (FIG. 1) and/or the pressure switch 37 in the syrup pathway (FIGS. 1 and 2) can be eliminated and the overall machine simplified. Optionally, a highly sensitive flow sensor is used to distinguish between air bubbles from the liquid such that flow rate detection is more accurate. One example of such a preferred sensor is the liquid flow sensor in the FS-100 series manufactured by Flo-Onics Systems Inc. of Tarzana, Calif.

The above description illustrates a few advantages of the present invention in comparison to the conventional mode of flow control. First, there is much less a chance for small particulate to cause the ratio control system to fail as is with the conventional ceramic flow controls. As water flow is always programmed to follow syrup flow, the majority of the syrup if not all is always flushed away in the conducting parts common to both liquids at the end of each filling cycle. Second, temporary interruptions in the supply of either liquid will not compromise the brix ratio in the product as the filling cycle will resume once the operator is able to replenish the supply and the volume of either liquid in the product mixture does not need to be adjusted. This is because each liquid is sequentially delivered, giving the control a chance to adjust the volume of the other liquid accordingly. Third, since both syrup and water use the same flow sensor, if the sensor accuracy changes slightly or is mis-calibrated, it affects both fluids and the effect on the ratio should be minimal. Fourth, no mechanical adjustment is needed in the proportioning mechanism, and adjustments can be made through a user-friendly computer-command menu. This is particularly advantageous when the input volume of one or more fluids needs to be changed. For example, a much larger volume of water is needed for routine sanitization and cleaning of the mixing container. Fifth, parts previously devoted exclusively for monitoring liquid-out situations can now be eliminated.

An example is now described to illustrate how to select the appropriate flow sensor in accordance with the present invention. A typical FCB unit dispenses semi-frozen products at 3 to 4 oz/sec and at approximately 100% overrun. For cup sizes that fall within the 16 oz to 48 oz range, it takes between 4 to 16 seconds to fill up the cup with the finished product. This means that 1.5 oz to 2 oz of liquid is dispensed each second from the unit. To replenish the freezing cylinder at the same rate that liquid is being dispensed from the unit, the mixing container needs to be refilled at a rate of 1.5 to 2 oz/sec.

Typically, the water to syrup volume ratio falls within the range of 1:1 to 5:1. If the water to syrup ratio is 5:1, to fill a 16 oz cup in 4 seconds, at 100% overrun (equal amount of gas and liquid), 1.33 oz of syrup and 6.67 oz of water to a total volume of 8 oz need to be delivered in 4 seconds to replenish the mixing container. If the 4 seconds are to be split equally between the syrup flow and the water flow, the syrup flow should be restricted to about 0.66 oz/sec and the water flow should be restricted to approximately 3.33 oz/sec. A flow sensor should be selected that can handle flow rates between approximately 0.2 gpm to 2 gpm.

In operation, both solenoid valves controlling the syrup and water flow are normally closed. When liquid level in the mix container drops to where the float switch is triggered, the microprocessor-equipped control starts the filling cycle by first opening the syrup valve. The control system continues to monitor the syrup volume until 1.33 oz syrup has passed by the sensor, at which point the control closes the syrup valve. If it takes significantly more than 2 seconds for the 1.33 oz syrup volume to pass the flow sensor, the control system diagnoses a "syrup out" condition, and switches to deliver a volume of water that equals five times the volume of syrup already delivered, and then suspends the filling activities by giving out "syrup out" warning. If 1.33 oz of syrup is delivered in 2 seconds, the control system subsequently opens the water valve, and when 6.67 oz of water has passed by the flow sensor, it shuts off the water valve. If 6.67 oz of water is not delivered in about two seconds, the control system gives out a "water fault" warning signal and suspends filling cycle until the problem is remedied, at which point the shortfall amount of water is delivered. This complete cycle is repeated if the level in the mix container has not satisfied the float switch. If the float switch is satisfied during a particular filling cycle, the full filling cycle is still carried out. Of course, the control can be programmed to stop further syrup delivery when the float switch is satisfied while syrup is being delivered and just deliver a volume of water that equals the product of the desired water to syrup ratio and the syrup already delivered in that cycle.

Figure 4B:
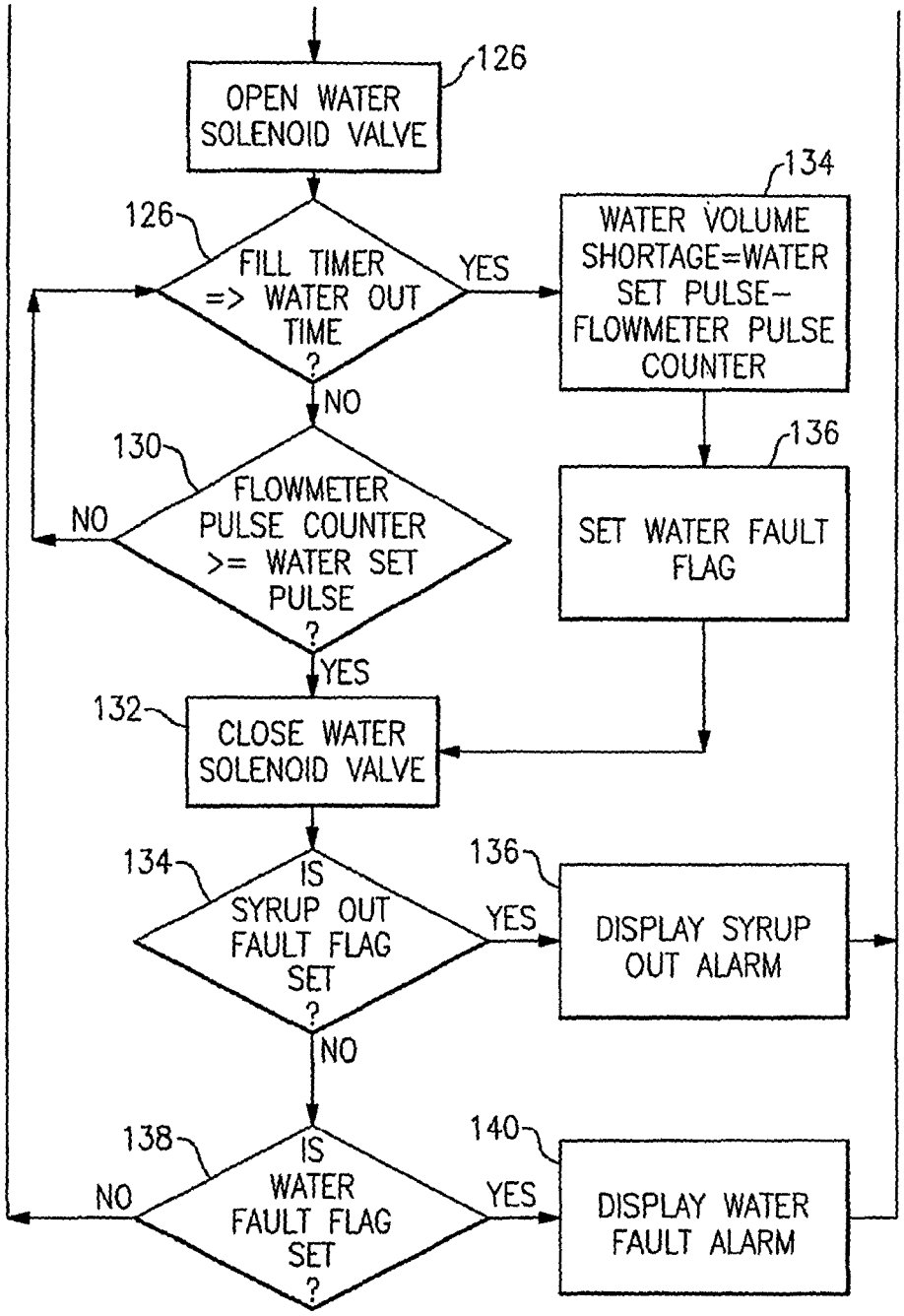

Referring now to FIGS. 4A and 4B, a flow diagram is provided to illustrate how the control system of the present invention is programmed for its functions. For the software program to work, a few fixed values need to be defined or entered by the operator for the control system. These values include several constants for each filling cycle shown in block 100: Syrup Volume (also characterized as Syrup Set Pulse which is the number of flowmeter pulses corresponding to the specified syrup volume, e.g., 30 pulses for 1 oz of syrup), Syrup Out Time (maximum allowable time, as measured by the fill timer, for the required volume of syrup to be delivered), and Water Out Time (maximum allowable time, as measured by the fill timer, for the required volume of water to be delivered). The Water/Syrup Ratio (block 101) is typically entered by the operator to define the required ratio between the two fluids. Some of the variables that appears in the program are shown in block 102 and include readings on the Flowmeter Pulse Counter (this counter accumulates the pulses as fluid passes by the flowmeter), readings on the Fill Timer (monitors time that takes a fluid volume to pass the flowmeter), "Water Set Pulse" and "Water Volume Shortage" as defined in the program and explained below.

The control system maintains a constant feedback loop that performs the core task of filling the mixing container or freezing cylinder under operational conditions. Upon entering the filling routine (block 103), the control system first determines if Water Volume Shortage's value is more than zero (block 104). Normally, this answer should be "no" (the "yes" scenario is explained below) and the program proceeds to the next step (block 105), which is to test if the float in the mixing container is satisfied or its equivalent, e.g., a pressure trigger in the freezing cylinder. If the float switch is satisfied, the program exits the filling routine (block 106); if not, the program starts the filling cycle (block 108) by re-zeroing and restarting the Fill Timer and Flowmeter Pulse Counter (to start recording volume). The next step is to open the syrup solenoid valve (block 110), and start the next feedback loop to see if by the time the Flowmeter Pulse Counter reaches the value set for the Syrup Volume, i.e., Syrup Set Pulse (block 114), the time recorded by the Fill Timer has passed the limit set for "Syrup Out," i.e., "Syrup Out Time" (block 112). If syrup running time exceeds the limit before the program is able to proceed to the next step (block 116), a "Syrup Out" flag is set (block 120), and the syrup solenoid valve is closed nevertheless (block 116).

After the syrup valve is closed (block 116), the value for Water Set Pulse is calculated as the product of the Flowmeter Pulse Counter's reading times the Water/Syrup Ratio (block 122). Then the Fill Timer and the Flowmeter Pulse Counter are re-zero and re-started (block 124). Consequently, the water solenoid valve is opened (block 126), and the program enters a smaller loop that governs water volume control. Specifically, a new feedback loop is activated to see if by the time the Flowmeter Pulse Counter reaches the value set for water (block 130), time recorded by the Fill Timer has passed the limit set for "Water Fault" (block 128). If water running time exceeds the limit (i.e., Water Out Time) before the program is able to proceed to the next step (block 132) in which the water solenoid valve is closed, the water-out loop is activated where a value for "Water Volume Shortage" is calculated as the value for Water Set Pulse minus the reading on the Flowmeter Pulse Counter (block 134), a "Water Fault" flag is set (block 136), and the water solenoid valve is closed nevertheless (block 132). Once the water solenoid valve is closed, the control system checks to see if syrup out fault has been flagged (block 134)—if so, it displays the syrup out alarm (block 136). The control system then checks to see if water fault has been flagged (block 138) and if so, displays the water fault alarm (block 140). As noted in the water fault loop, a value for "water volume shortage" is calculated (block 134). When that value becomes positive (block 104 in FIG. 4A) indicating a water fault, the control system proceeds to reset the Water Set Pulse value to that of "Water Volume Shortage" (block 144). The control system then proceeds to restart the Timer and Flowmeter Pulse Counter (block 124) and starts delivering water. This time, the Flowmeter Pulse Counter will be checked against the newly set Water Set Pulse that equals "Water Volume Shortage" to compensate whatever shortfall due to previous water fault.

While the invention has been described with certain embodiments so that aspects thereof may be more fully understood and appreciated, it is not intended to limit the invention to these particular embodiments. On contrary, it is intended to cover all alternatives, modifications and equivalents as may be included within the scope of the invention as defined by the appended claims.

What is claimed is:

1. A semi-frozen beverage dispenser comprising:

a mixing container;

a first valve situated in a syrup pathway for regulating a syrup flow into the mixing container;

a second valve situated in a diluent pathway for regulating a diluent flow into the mixing container;

a flow sensor situated downstream of both valves and upstream of the mixing container for generating a signal relating to the volume of any liquid flow that has passed by the sensor; and a control system in electronic communication with the flow sensor for receiving its signal, the control system being configured to shut off the first valve after the flow sensor has indicated that a first preset volume of syrup has passed by and to consequentially open the second valve to allow a second preset volume of diluent to pass by the sensor before the control system shuts off the second valve, such that a desired ratio between the syrup and the diluent is achieved in the mixing container;

further comprising a freezing cylinder situated downstream of the mixing container.

2. The semi-frozen beverage dispenser of claim 1, further comprising a flow restrictor disposed upstream of at least one of said first and second valves to limit the maximal rate of flow to said valve.

3. The semi-frozen beverage dispenser of claim 1, wherein the mixing container is configured to chill its content.

4. The semi-frozen beverage dispenser of claim 1, wherein the control system comprises a microprocessor.

5. The semi-frozen beverage dispenser of claim 1, wherein the flow sensor is capable of distinguishing between liquid and gas.

6. A semi-frozen beverage dispenser comprising:

a mixing container;

a first valve situated in a syrup pathway for regulating a syrup flow into the mixing container;

a second valve situated in a diluent pathway for regulating a diluent flow into the mixing container;

a flow sensor situated downstream of both valves and upstream of the mixing container for generating a signal relating to the volume of any liquid flow that has passed by the sensor; and a control system in electronic communication with the flow sensor for receiving its signal, the control system being configured to shut off the first valve after the flow sensor has indicated that a first preset volume of syrup has passed by and to consequentially open the second valve to allow a second preset volume of diluent to pass by the sensor before the control system shuts off the second valve, such that a desired ratio between the syrup and the diluent is achieved in the mixing container;

wherein the control system is configured to diagnose that syrup is out when the first preset volume of syrup fails to pass by the sensor in a predetermined time wherein the control system is further configured to adjust the volume of diluent in the same filling cycle, after it has diagnosed that syrup is out, to maintain the desired ratio between the syrup and the diluent in the mixing container.

7. A semi-frozen beverage dispenser comprising;

a mixing container;

a first valve situated in a syrup pathway for regulating a syrup flow into the mixing container;

a second valve situated in a diluent pathway for regulating a diluent flow into the mixing container;

a flow sensor situated downstream of both valves and upstream of the mixing container for generating a signal relating to the volume of any liquid flow that has passed by the sensor; and a control system in electronic communication with the flow sensor for receiving its signal, the control system being configured to shut off the first valve after the flow sensor has indicated that a first preset volume of syrup has passed by and to consequentially open the second valve to allow a second preset volume of diluent to pass by the sensor before the control system shuts off the second valve, such that a desired ratio between the syrup and the diluent is achieved in the mixing container;

wherein the control system is configured to diagnose that diluent is out when the second preset volume of diluent fails to pass by the sensor in a predetermined time wherein the control system is further configured, after it has diagnosed that diluent is out, to maintain the desired ratio between the syrup and the diluent in the mixing container by requiring an additional volume of diluent delivered to the mixing container to make up the shortfall.

8. A method for achieving a desired ratio between a diluent and at least one syrup in a semi-frozen beverage dispenser, the method comprising:

providing a first valve to regulate a syrup flow into a mixing container;

providing a second valve to regulate a diluent flow into the mixing container;

providing a flow sensor downstream of both valves and upstream of the mixing container;

opening the first valve, and shutting it off after the flow sensor has sensed that a first preset volume of syrup has passed by; and consequently opening the second valve to allow a second preset volume of diluent to enter the mixing container, the ratio between the second preset volume and the first preset volume being the desired ratio;

diagnosing that syrup is out when the first preset volume of syrup fails to pass by the sensor in a predetermined time adjusting the volume of diluent in the same filling cycle, after syrup has been diagnosed as out, to maintain the desired ratio.

9. The method of claim 8, further comprising:

diagnosing that diluent is out when the second preset volume of diluent fails to pass by the sensor in a predetermined time.

* * * * *